US005653289A

United States Patent [19]

Hosie et al.

[11] Patent Number: 5,653,289

[45] Date of Patent: Aug. 5, 1997

[54] ADJUSTABLE JACKUP DRILLING SYSTEM HANGER

[75] Inventors: Stanley Hosie, Peterhead; Iain M. Oswald, Aberdeen; Trevor W. J. Park; Calum J. B. Dinnes, both of Bridge of Don, all of Great Britain

[73] Assignee: ABB Vetco Gray Inc., Houston, Tex.

[21] Appl. No.: 557,879

[22] Filed: Nov. 14, 1995

[51] Int. Cl.[6] ..... E21B 33/038

[52] U.S. Cl. ..... 166/348; 166/208; 166/141

[58] Field of Search ..... 166/208, 141, 166/348, 182, 382, 217

[56] References Cited

U.S. PATENT DOCUMENTS

| | | | |
|---|---|---|---|
| 4,561,499 | 12/1985 | Berner, Jr. et al. | 166/85 |
| 4,919,460 | 4/1990 | Milberger et al. | 166/75.1 X |
| 5,240,081 | 8/1993 | Milberger et al. | 166/368 X |
| 5,249,629 | 10/1993 | Jennings | 166/348 |
| 5,311,947 | 5/1994 | Kent et al. | 166/348 |
| 5,439,061 | 8/1995 | Brammer et al. . | |
| 5,450,904 | 9/1995 | Galle | 166/348 |
| 5,607,019 | 3/1997 | Kent . | |
| 5,638,903 | 6/1997 | Kent . | |

FOREIGN PATENT DOCUMENTS

| | | |
|---|---|---|
| 2270531 | 3/1994 | United Kingdom . |
| 2292162 | 2/1996 | United Kingdom . |
| 2299820 | 10/1996 | United Kingdom . |
| 2301127 | 11/1996 | United Kingdom . |

*Primary Examiner*—Frank Tsay
*Attorney, Agent, or Firm*—James E. Bradley

[57] ABSTRACT

A casing tensioning system applies tension to a string of casing between a subsea wellhead and a surface wellhead. The tensioning system has an outer hanger with a load ring and a ratchet ring that engage a mandrel. The mandrel is connected into the string of casing. The outer hanger has a disengaged position and an engaged position. When running, the outer hanger lands on a load shoulder in the surface wellhead while the casing hanger is in the disengaged position. The operator subsequently lowers the casing and latches the casing to the subsea wellhead. The operator then removes the casing running tool. The operator sets an annulus seal using a seal running tool. The annulus seal actuates a release member to cause the ratchet ring to move to the collapsed engaged position. After the seal is set the operator pulls tension on the casing.

21 Claims, 5 Drawing Sheets

ADJUSTABLE JACKUP DRILLING SYSTEM HANGER

BACKGROUND OF THE INVENTION

1. Field of the Invention:

This invention relates in general to offshore drilling equipment for oil and gas, and in particular to a system for tensioning a section of casing extending between a subsea wellhead at the sea floor and a surface wellhead located on a platform at the surface.

2. Description of the Prior Art:

When offshore drilling with a jackup drilling rig, the operator will first drill a large diameter bore and install a section of conductor. Various strings of casing will then be installed as the well is drilled deeper. A typical technique when installing the casing is to utilize mudline hangers. With a mudline hanger, the annulus of the casing is not sealed at the subsea wellhead, rather the casing extends through the subsea wellhead to a surface wellhead where an annulus seal seals around each section of casing. The surface wellhead or casing head is located on the platform normally about 90 feet below the drilling rig floor. The surface wellhead is supported by the conductor pipe extending from the subsea wellhead. At the subsea wellhead, a mudline latch on the casing engages a mudline hanger which transfers the weight of the casing it into the subsea wellhead housing.

When installing a string of casing, the operator will lower the string of casing into the well and latch it to the mudline hanger. The operator then pumps cement down the casing which flows back up the annulus surrounding the casing. Then the operator will open wash ports at the subsea wellhead and pump water down the casing to clean the area around the mudline hanger of cement. After the cement has set, the operator will apply tension to the portion of the casing that extends between the subsea wellhead assembly and the surface wellhead assembly, and secure the upper end of the casing in tension.

Various systems are used for adjusting the length of the casing between the subsea wellhead and surface wellhead and applying tension. These systems employ a variety of adjustable load shoulders, including rings mounted to the casing which operate with rotation, rings that mount to the casing and adjust by ratcheting, and others that move casing head shoulders.

SUMMARY OF THE INVENTION

In this invention, the tensioning system includes an annular casing hanger carried by the string of casing. The casing hanger has a disengaged position which allows downward movement of the string of casing relative to the casing hanger. It has an engaged position which allows upward movement of the string of casing relative to the casing hanger but prevents downward movement. The lock member lands on a load shoulder in the surface wellhead housing as the string of casing is being lowered by a casing running tool. After the casing hanger lands, the string of casing is lowered further to latch it into the subsea wellhead assembly. The casing hanger is maintained in the disengaged position during this procedure.

Then, an annulus seal running tool is lowered to set an annulus seal between the bore and an external seal surface formed on the casing hanger. A release member moves the casing hanger to the engaged position. This allows the string of casing to be pulled upward relative to the casing hanger to apply and maintain tension in the string of casing.

The casing hanger includes an external load ring and an internal ratchet ring. The ratchet ring engages external grooves formed on a mandrel, which forms part of the casing string. The ratchet ring is resiliently expansible and contractible and is initially held in an expanded position by a key. The key locates within a split of the ratchet ring. When the annulus seal is lowered into place, it pushes the release member downward to move the key downward, allowing the ratchet ring to contract to the engaged position.

DETAILED DESCRIPTION OF THE INVENTION

Figure 1:
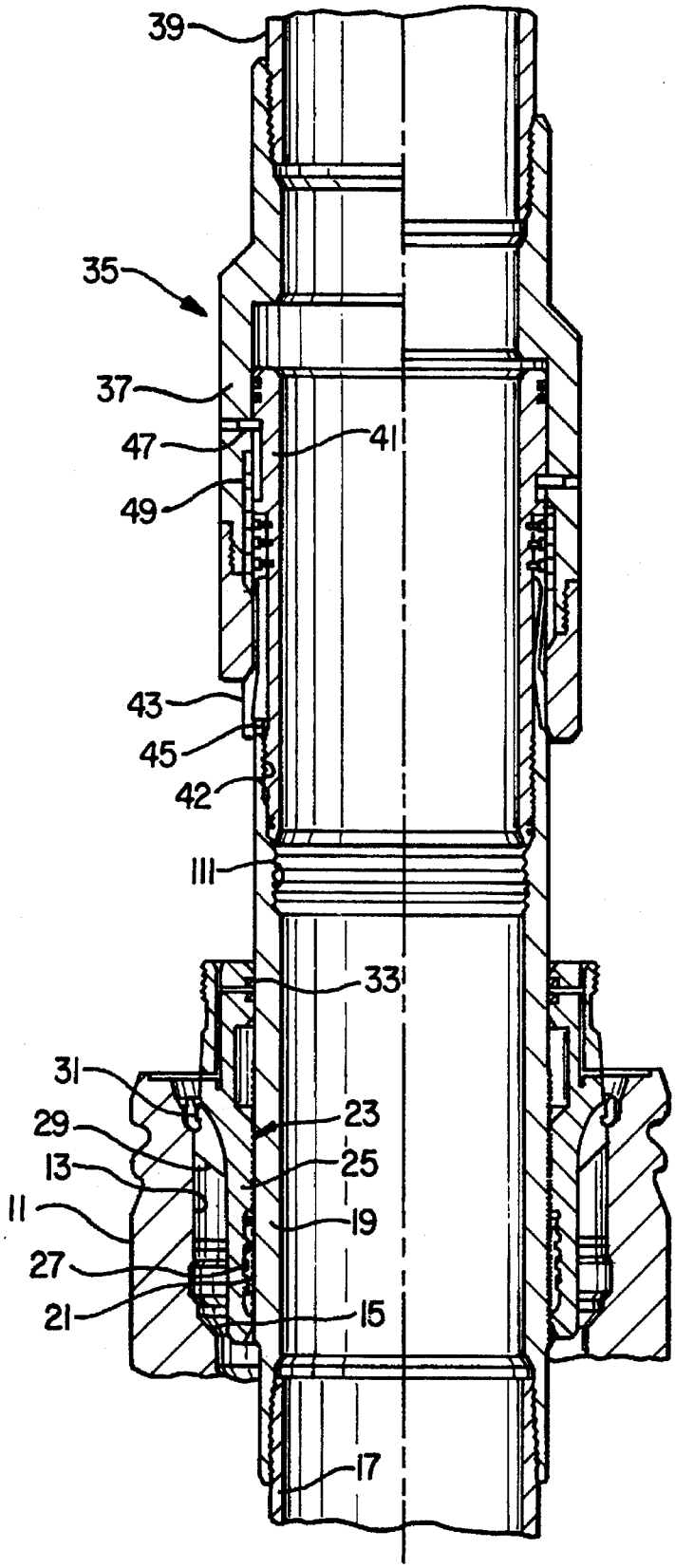
FIG. 1 is a vertical sectional view illustrating a casing hanger instructed in accordance with this invention engaged by a casing running tool, with the right side showing the casing running tool in a lower position and the left side showing the casing running tool in an upper position.

Referring to FIG. 1, a surface wellhead housing or casing head 11 will be supported above a subsea wellhead (not shown) located at the sea floor. Casing head 11 will be supported on a riser conductor (not shown) extending upward from the subsea wellhead. Casing head 11 is normally located at a well deck of a jackup drilling rig, with the well deck being about 90 feet below the rig floor. Casing head 11 has an axial bore 13 which contains an upward facing conical load shoulder 15.

A string of casing 17 is being shown lowered through casing head 11, through the subsea wellhead and into the well. A tubular mandrel 19 is connected into the string of casing 17 and becomes a part of the string of casing 17. Mandrel 19 is also part of a hanger system, and may be considered an inner hanger portion of a casing hanger. Mandrel 19 has a set of external grooves 21, which are threads in the preferred embodiment.

An outer hanger 23 is carried on mandrel 19, forming a second part of a casing hanger. Outer hanger 23 includes a load ring 25 and a ratchet ring 27. Load ring 25 has a downward facing landing shoulder 29 which will land on load shoulder 15. Ratchet ring 27 is carried within an inner recess in load ring 25 for engaging the mandrel threads 21. A retainer 31, which is a split ring, will engage a groove in bore 13 to latch load ring 25 in place. Load ring 25 has an upper portion that extends radially inward and contains an inner seal 33. Seal 33 engages an exterior seal surface formed on mandrel 19.

In the position shown, outer hanger 23 is shown located at the lower end of the set of external threads 21. Furthermore, it is shown spaced some distance above load shoulder 15 because the drawing shows a casing running tool 35 in the process of lowering the assembly. Casing running tool 35 is conventional having an outer sleeve 37 which is supported by conduit 39 that will be lifted by the drilling rig. An inner sleeve 41 locates in outer sleeve 37. Inner sleeve 41 is connected by threads at its lower end to threads 42 of mandrel 19. Inner sleeve 41 has torque keys 43 located between it and outer sleeve 37. Torque keys 43 are aligned to match with milled slots 45 formed in the upper end of mandrel 19. A J-pin 47 allows outer sleeve 37 to be moved downward from the upper position shown on the left side to a lower position shown in the right side. When doing so, outer sleeve 37 will force torque keys 43 inward to engage slots 45. When in the lower position, rotation of conduit 39 will rotate mandrel 19 and casing 17. Load carrying teeth 49 are located between the inner sleeve 41 and outer sleeve 37.

Briefly explaining the operation of running casing 17, inner sleeve 41 is secured to threads 42, and torque keys 43 are aligned with slots 45. Outer sleeve 37 is lowered relative to inner sleeve 41 to the position shown on the right side of FIG. 1, forcing torque keys 43 inward into slots 45. Conduit 39 is then rotated approximately 45 degrees left-hand. This engages load carrying teeth 49 between inner sleeve 41 and outer sleeve 37. The casing string 17 can now be picked up with the load passing through teeth 49.

Casing running tool 35 will lower the assembly until shoulder 29 of load ring 25 lands on casing head shoulder 15. Ratchet ring 27 will be held in a disengaged position, as will be explained subsequently, which allows further downward movement of mandrel 19 relative to load ring 25. The operator continues to lower casing 17 and latches casing 17 to the mudline hanger (not shown) at the subsea wellhead. The operator then pumps cement down casing 17, which flows back up the annulus.

After cementing, the operator rotates conduit 39 to open wash ports (not shown) located at the subsea wellhead. This is handled by left-hand rotation, with torque keys 43 preventing threads 42 from becoming unscrewed while this occurs. The operator pumps water down the casing 17, which flows back up the wash ports to wash the mudline latch area of the subsea wellhead. The operator then closes the wash ports by right-hand rotation.

The operator then releases casing running tool 35 by applying the weight of conduit 39. This moves the J-pins 47 to the bottom of the J-slots (not shown). Then, right-hand rotation and lifting upward will lift outer sleeve 37, releasing torque keys 43 as shown on the left-side of FIG. 1. Further right-hand rotation unscrews inner sleeve 41 from threads 42. Casing running tool 35 is then removed, leaving mandrel 19 and outer hanger 23 in place. Outer hanger 23 will be located in engagement with load shoulder 15. Tension will not yet be applied to the section of casing 17 between the subsea wellhead assembly and casing head 11.

Figure 2:
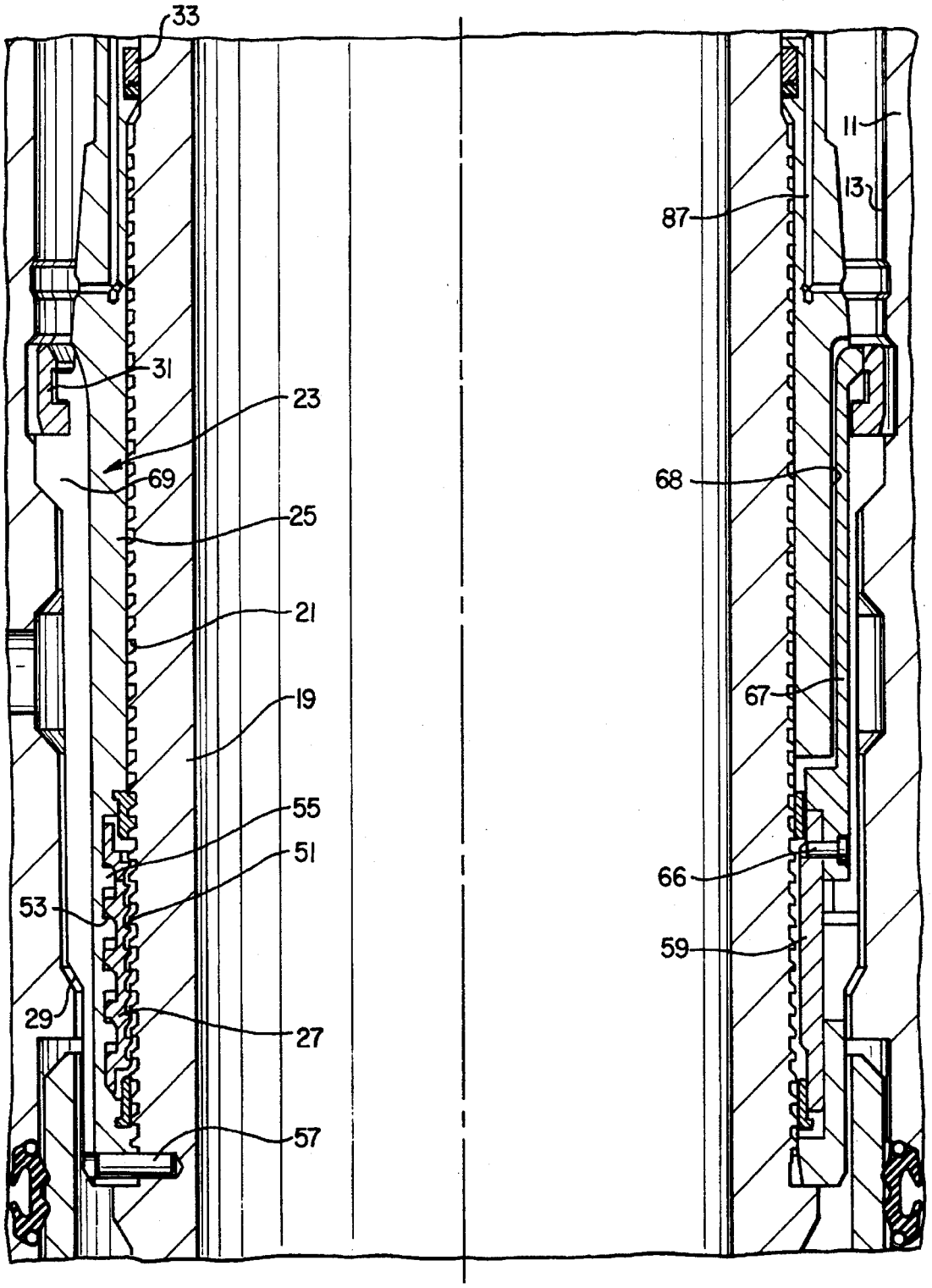
FIG. 2 is an enlarged sectional view of a portion of the casing hanger of FIG. 1, taken along the line of II—II of FIG. 3.

The remaining figures illustrate the annulus seal and the structure that allows the tensioning to be applied. Referring to FIG. 2, ratchet ring 27 is preferably of the same general type as shown in U.S. Pat. No. 4,607,865, David W. Hughes, issued Aug. 26, 1986. Ratchet ring 27 has internal teeth 51 which engage the external threads 21 on mandrel 19. Ratchet ring 27 has external load shoulders 53 which engage internal load shoulders 55 in load ring 25. A shear pin 57 serves to initially hold outer hanger 23 on mandrel 19 at the base of the external threads 21. Shear pin 57 will shear after load ring 25 lands on load shoulder 15 and additional weight from conduit 39 (FIG. 1) is applied. This allows mandrel 19 to move downward relative to load ring 25 for latching into the subsea wellhead assembly.

Figure 3:
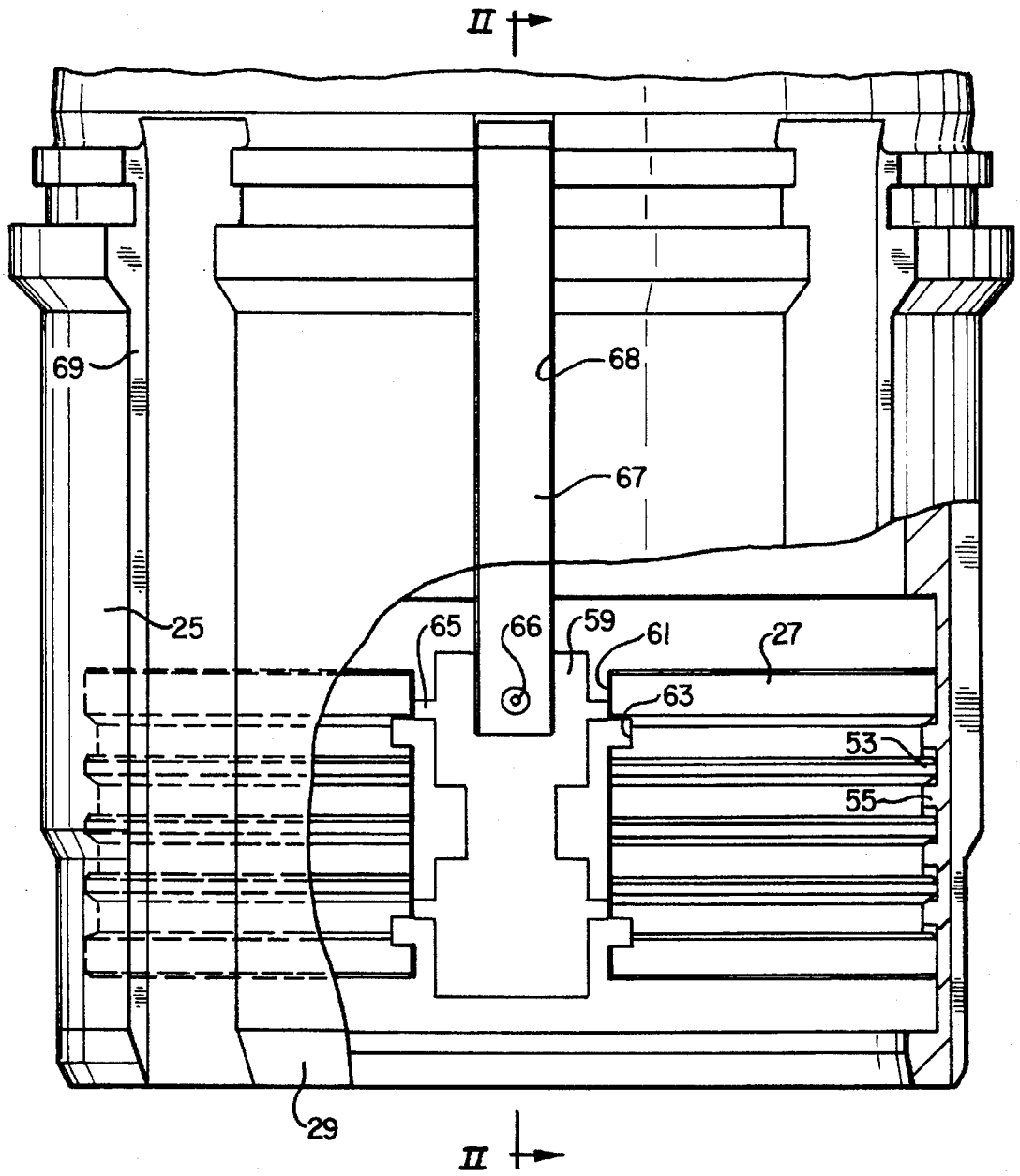
FIG. 3 is an enlarged elevational view, partially sectioned, an illustrating portions of the casing hanger of FIG. 1.

Ratchet ring 27 allows this downward movement because it is held initially in an expanded position such that it will not engage mandrel external threads 21 to prevent downward movement of mandrel 19. As shown also in FIG. 3, the means to hold ratchet ring 27 in the expanded disengaged position includes a key 59. Key 59 locates in the split of ratchet ring 27, which is resilient. The split of ratchet ring 27 includes two opposed edges 61. Each edge 61 has a pair of rectangular recesses 63. Key 59 has two lugs 65, each extending laterally from an opposite side of the body of key 59. Lugs 65 will engage edges 61 when key 59 is in the upper position shown. This holds ratchet ring 27 in an expanded position. When key 59 is moved downward, lugs 65 enter recesses 63. This allows the resiliency of ratchet ring 27 to contract ratchet ring 27 to the engaged position.

The means for releasing key 59 includes a rod 67 which extends upward and is secured by a pin 66 to key 59. Rod 67 extends through a slot 68 formed in the load ring 25. Slot 68 joins an elongated hole through which pin 66 extends. Key 59 is located on an inner recess portion of load ring 25 while rod 67 is located in slot 68 on the outer side of load ring 25. Load ring 25 also has vertical flowby slots 69 to allow the passage of well fluid.

Figure 4:
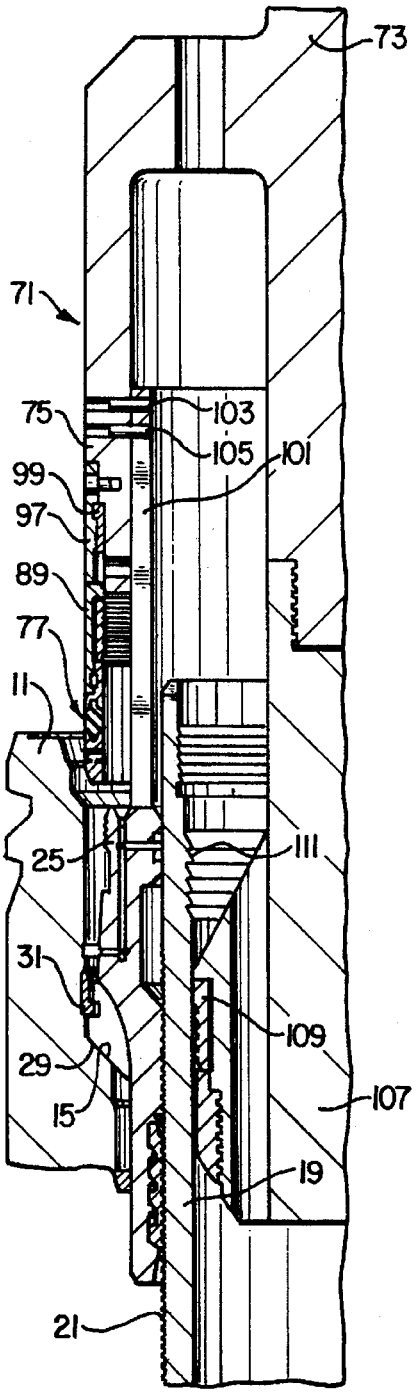
FIG. 4 is a vertical sectional view of a portion of the casing hanger of FIG. 1, showing the casing running tool removed and a seal running tool in the process of setting an annulus seal.
Figure 5:
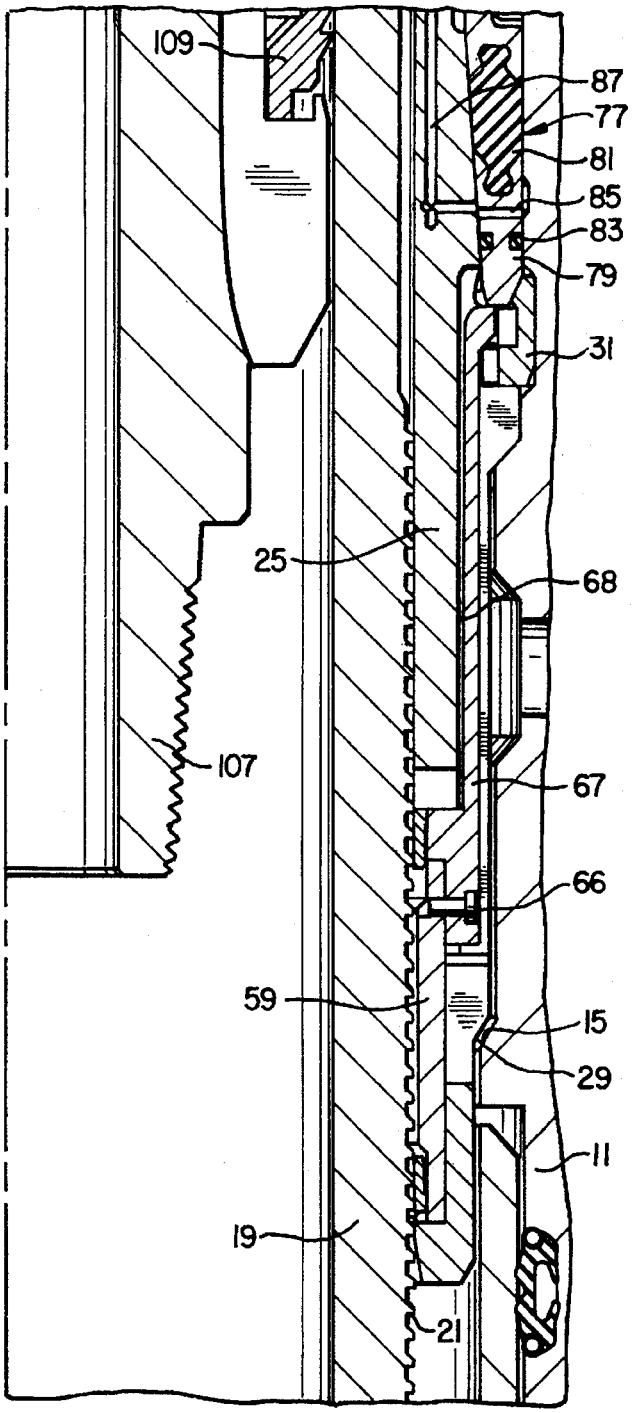
FIG. 5 is an enlarged view of a portion of the casing hanger of FIG. 1, showing a portion of the annulus seal set.
Figure 6:
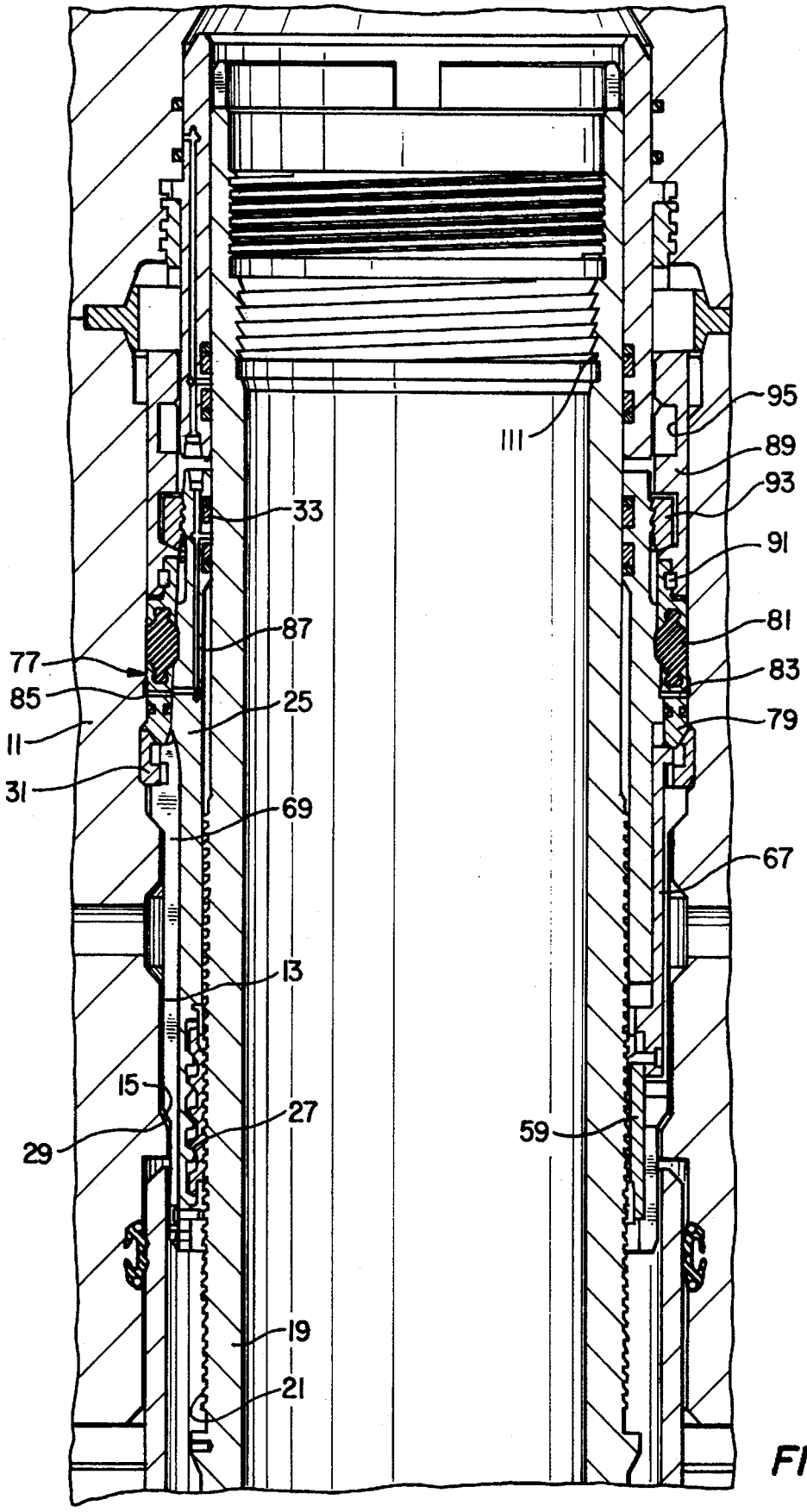
FIG. 6 is a sectional view of the casing hanger of FIG. 1, shown in its final position.

Rod 67 is pushed downward during the annulus seal running process as illustrated in FIGS. 4–6. After casing running tool 35 (FIG. 1) is removed, a seal running tool 71 is lowered into casing head 11. Seal running tool 71 has a body 73 with threads (not shown) at its upper end for securing to conduit. An outer sleeve 75 is integrally formed with body 73 and extends downward. An outer casing hanger seal 77 is releasably carried by outer sleeve 75. Outer seal 77 is a prior art type and is set by conventional techniques. Referring to FIG. 6, the outer seal 77 shown is a combination metal and elastomer, having a metal body 79 which has upper and lower portions. An elastomeric seal element 81 is carried between the upper and lower portions of metal body 79. An O-ring outer test seal 83 is located on the lower portion of metal body 79 below seal element 81. A radial test port 85 extends through the lower portion of metal body 79 between seal element 81 and test seal 83. Test port 85 communicates with a test passage 87 formed in load ring 25 and also with a test passage (not shown) formed in casing head 11.

Outer seal 77 is carried, set, and retained by a retainer nut 89 which remains with the installation after running tool 71 is removed. Retainer nut 89 is coupled to outer seal 77 through a split retainer ring 91, which allows rotation of retainer nut 89 relative to outer seal 77. Retainer nut 89 carries on its inner diameter a split internally threaded ring 93 which ratchets and engages external locking threads on load ring 25. A key (not shown) prevents retainer nut 89 from rotating relative to threaded ring 91. Retainer nut 89 has circumferentially spaced J-slots 95 on its upper rim. Each J-slot 95 has an axial portion for transmitting rotation and a circumferential portion for use with a retrieval tool (not shown).

Referring again to FIG. 4, torque keys 97 secured to outer sleeve 75 extend straight downward and enter the axial portion of J-slots 95 (FIG. 6) for transmitting rotation to retainer nut 89. Torque keys 97 extend through slots within a protective sleeve which is not shown and is mounted to outer sleeve 75. Torque keys 97 are straight members which do not engage the circumferential portion of J-slots 95, rather only the axial portions of J-slots 95.

Referring still to FIG. 4, a collet 99 is secured to outer sleeve 75 by the same protective sleeve (not shown) that supports torque keys 97. Collet 99 serves to releasably carry retainer nut 89 and thereby outer sleeve 75. Collet 99 is a sleeve with a plurality of slits to allow radial flexibility. Collet 99 has an external circumferential rib which frictionally engages an annular groove in the inner diameter of retainer nut 89 near its upper rim. Rotation of outer sleeve 75 will tighten retainer nut 89 through torque keys 97 to set and retain outer seal 77. A straight upward pull on outer sleeve 75 causes the rib on collet 99 to release from retainer nut 89 and causes torque keys 97 to pull from the J-slots 95 and retainer nut 89.

Seal running tool 71 also has an inner sleeve 101 carried on the inner diameter of outer sleeve 75. Inner sleeve 101 has a lower end that will abut the upper end of load ring 25. Shear pins 103 will carry outer sleeve 75 in an upper position relative to inner sleeve 101, then allow it to move to a lower position after shearing. Inner sleeve 101 has a plurality of elongated axial slots which receive retainer pins 105 to retain inner sleeve 101 with outer sleeve 75.

Seal running tool 71 also has a downward extending mandrel or hub 107. Hub 107 is adapted to slide within the bore of mandrel 19. Hub 107 has a gripping ring 109 which is split and biased outward. Gripping ring 109 will slide freely downward pass lifting grooves 111 formed in the bore of mandrel 19. Lifting grooves 111 and the teeth of gripping ring 109 are saw-toothed and inclined to allow downward movement. Hub 107 can also move freely upward with gripping ring 109 sliding in the bore of mandrel 19 until the teeth of gripping ring 109 fully contact and mesh with the lifting grooves 111. The teeth of gripping ring 109 are configured so that they will not spring outward into engagement with lifting grooves 111 until fully aligned with all of the teeth or grooves of mandrel 109 meshing with all of the lifting grooves 111.

In the operation for installing outer seal 77, the well assembly will appear as shown in FIG. 4. The operator lowers running tool 71 causing inner sleeve 101 to contact the upper end of load ring 25. The weight of the conduit on outer sleeve 75 causes shear pins 103 to shear. Outer sleeve 75 will then move downward, and the lower end of outer seal 77 will contact rod 67, as shown in FIG. 5. The lower end of outer seal 77 also pushes retainer ring 31 outward into the recess in casing head 13. At the same time, the metal body 79 of seal 77 will push rod 67 downward, thereby moving key 59 downward. The lugs 65 of key 59 will enter recesses 63 (FIG. 3), allowing ratchet ring 27 to collapse to the engaged position.

During the downward movement of outer seal 77, threaded ring 93 (FIG. 6) will ratchet and engage the locking threads on mandrel 19. Then, the operator rotates seal running tool 71 to fully set outer seal 77. Threaded ring 93 rotates with retainer nut 89 while outer seal 77 remains stationary. This rotation applies additional torque and causes outer seal 77 to fully set between bore 13 of casing head 11 and the exterior of load ring 25.

Seal running tool 71 is released by pulling straight upward. The rib of collet 99 snaps loose from the groove within retainer nut 89. Torque keys 87 move straight upward from J-slots 95 in retainer ring 91. As the body 79 of seal running tool 71 moves upward, hub 107 will also move upward with gripping ring 109 sliding up the bore of mandrel 19. Once gripping ring 109 has fully aligned with lifting grooves 111, gripping ring 109 will spring outward into meshed engagement.

Continued upward movement then causes mandrel 19 to move upward relative to outer hanger 23, applying tension to the section of casing 17 (FIG. 1) between the subsea wellhead and surface casing head 11. Ratchet ring 27 (FIG. 2) will ratchet on external threads 21. When the desired amount of tension has been reached, the operator can release the pull, and ratchet ring 27 will hold the tension in casing 17 by transmitting the load to outer hanger 23 and from there to casing head 11. Seal running tool 71 is released from outer hanger 23 by rotation of seal running tool 71. This results in the gripping ring 109 unscrewing from lifting threads 111.

The inner seal 33 and outer seal 77 can be tested by applying fluid pressure to a test passage leading through casing head 11. Test fluid flows through test port 85 and test passages 87. The fluid acts between the two inner seals 33. Also, the pressure acts between the seal element 81 and test outer seal 83. If the pressure holds, this indicates that all the various seals have been properly sealed. At this point, the operator will then install another casing head on top of casing head 11 as shown in FIG. 6. Other strings of casing may be run in a similar manner.

The invention has significant advantages. The disengaged position of the ratchet ring allows the casing to be lowered and rotated to latch into a subsea wellhead after the load ring has landed on the load shoulder. The releasing of the disengaged position occurs while running the seal. This allows tensioning to be made to the string after the seal has been set.

While the invention has been shown in only one of its forms, it should be apparent to those skilled in the art that it is not so limited, but is susceptible to various changes without departing from the scope of the invention.

We claim:

1. An apparatus for running and supporting in tension a string of casing extending from a subsea wellhead assembly to a surface wellhead which has a bore with a load shoulder, comprising in combination:

an annular casing hanger carried by the string of casing, the casing hanger having a disengaged position which allows downward movement of the string of casing relative to the casing hanger and an engaged position which allows upward movement of the string of casing relative to the casing hanger but prevents downward movement;

an external annular seal surface on the casing hanger;

casing running tool means for lowering the string of casing through the surface wellhead housing, landing the casing hanger on the load shoulder, then further lowering the string of casing to latch the string of casing to the subsea wellhead assembly while the casing hanger is in the disengaged position;

annulus seal running tool means for lowering and setting an annulus seal between the bore and the external seal surface of the casing hanger; and release means for moving the casing hanger to the engaged position, allowing the string of casing to be pulled upward relative to the casing hanger to apply and maintain tension in the string of casing.

2. The apparatus according to claim 1, wherein the release means is actuated in response to the annulus seal running tool means, which moves a lower end of the annulus seal downward into contact with the release means while setting the annulus seal.

3. The apparatus according to claim 1, wherein the string of casing includes a mandrel having a set of external grooves and wherein the casing hanger comprises:

an external load ring; and a ratchet ring carried within the load ring, the ratchet ring having internal grooves that engage the external grooves on the mandrel, the ratchet ring having a split and being radially expansible and contractible; and wherein the release means comprises:

a key which locates within the split of the ratchet ring in a first position for holding the ratchet ring in the disengaged position, and which moves from the first position to a second position, causing the ratchet ring to contract to the engaged position.

4. The apparatus according to claim 1, wherein the string of casing includes a mandrel having a set of external grooves and wherein the casing hanger comprises:

an external load ring; and a ratchet ring carried within the load ring, the ratchet ring having internal grooves that engage the external grooves on the mandrel, the ratchet ring having a split and being radially expansible and contractible; and wherein the release means comprises:

a key which locates within the split of the ratchet ring in an upper position for holding the ratchet ring in the disengaged position, and which moves from the upper position to a lower position when contacted by a lower end of the annulus seal, causing the ratchet ring to contract to the engaged position.

5. The apparatus according to claim 1, further comprising:

an inner seal which seals between an inner diameter of the casing hanger and the string of casing.

6. The apparatus according to claim 1, wherein the annulus seal running tool means is employed to apply tension to the casing string after setting the annulus seal.

7. An apparatus for connecting a string of casing between a subsea wellhead assembly and a surface wellhead which has a bore with a load shoulder, comprising in combination:

an annular casing hanger carried by the string of casing, the casing hanger having a disengaged position which allows downward movement of the string of casing relative to the casing hanger and an engaged position which allows upward movement of the string of casing relative to the casing hanger, but prevents downward movement;

an external annular seal surface on the casing hanger;

casing running tool means for lowering the string of casing through the surface wellhead housing, landing the casing hanger on the load shoulder, then further lowering the string of casing to latch the string of casing to the subsea wellhead assembly while the casing hanger is in the disengaged position; and annulus seal running tool means for lowering and setting an annulus seal between the bore and the external seal surface of the casing hanger, for moving the casing hanger to the engaged position, and for pulling the string of casing upward relative to the casing hanger while the casing hanger is in the engaged position to apply and maintain tension in the string of casing.

8. The apparatus according to claim 7, wherein the annulus seal running tool means moves the casing hanger to the engaged position by moving a lower end of the annulus seal downward into contact with the casing hanger.

9. The apparatus according to claim 7, wherein the string of casing includes a mandrel having a set of external grooves and wherein the casing hanger comprises:

an external load ring;

a ratchet ring carried within the load ring, the ratchet ring having internal grooves that engage the external grooves on the mandrel, the ratchet ring having a split and being radially and resiliently expansible and contractible;

key means which locates within the split of the ratchet ring in a first position for holding the ratchet ring in the disengaged position; and release means which is engaged by the annulus seal for moving the key means from the first position to a second position, allowing the ratchet ring to contract to the engaged position.

10. The apparatus according to claim 7, wherein the string of casing includes a mandrel having a set of external grooves and wherein the casing hanger comprises:

an external load ring;

a ratchet ring carried within the load ring, the ratchet ring having internal grooves that engage the external grooves on the mandrel of the string of casing, the ratchet ring having a split and being radially and resiliently expansible and contractible;

a key which locates within the split of the ratchet ring in an upper position for holding the ratchet ring in the disengaged position; and a release member having a lower end which engages the key and an upper end which is contacted by the annulus seal when run, moving the key downward within the split, allowing the ratchet ring to contract to the engaged position.

11. The apparatus according to claim 7, further comprising:

an inner seal which seals between an inner diameter of the casing hanger and a mandrel.

12. The apparatus according to claim 7 wherein the annulus seal running tool means moves the casing hanger to the engaged position after setting the annulus seal.

13. An apparatus for supporting a string of casing between a subsea wellhead assembly and a surface wellhead which has a bore with a load shoulder, comprising in combination:

a mandrel connected to and forming a part of the string of casing, the mandrel having a set of external grooves;

an external load ring adapted to land on the load shoulder;

a ratchet ring carried within the load ring, the ratchet ring having internal grooves that engage the external grooves, the ratchet ring having a split and being radially and resiliently expansible and contractible;

a key within the split of the ratchet ring, being movable from an upper position for holding the ratchet ring in an expanded disengaged position which allows downward movement of the mandrel relative to the ratchet ring to connect a lower end of the string of casing to the subsea wellhead assembly, to a contracted lower position which allows upward but not downward movement of the mandrel relative to the ratchet ring to support the string of casing in tension; and a release member connected to the key and extending upward for moving the key from the upper position to the lower position when the release member is moved downward.

14. The apparatus according to claim 13, wherein:

the split of the load ring comprises opposing edges, each of the edges having a laterally extending recess; and the key has a pair of laterally extending lugs which engage the edges when the key is in the upper position and which enter the recesses when the key is in the lower position.

15. The apparatus according to claim 13, wherein the release member comprises a rod.

16. The apparatus according to claim 13, further comprising an annulus seal which is lowered into and set between the bore and the load ring; and wherein the release member is moved downward by downward movement of the annulus seal while the annulus seal is being lowered and set.

17. The apparatus according to claim 13, further comprising:

an inner seal which seals between an inner diameter of the load ring and the mandrel.

18. An apparatus for running and supporting a string of casing between a subsea wellhead assembly and a surface wellhead which has a bore with a load shoulder, comprising in combination:

a mandrel connected to and forming a part of the string of casing, the mandrel having a set of external grooves;

an external load ring adapted to land on the load shoulder, the load ring having an external seal surface;

an inner seal which seals between an inner diameter of the load ring and the mandrel;

a ratchet ring carried within the load ring, the ratchet ring having internal grooves that engage the external grooves, the ratchet ring having a split and being radially and resiliently expansible and contractible;

a key within the split of the ratchet ring, being movable from an upper position for holding the ratchet ring in an expanded disengaged position which allows downward movement of the mandrel relative to the ratchet ring, to a contracted lower position which allows upward but not downward movement of the mandrel relative to the ratchet ring to support the string of casing in tension;

a release member connected to the key and extending upward for moving the key from the upper position to the lower position;

casing running tool means for lowering the string of casing through the surface wellhead housing, landing the load ring on the load shoulder, then further lowering the string of casing to latch the string of casing to the subsea wellhead assembly while the ratchet ring is in the disengaged position; and annulus seal running tool means for lowering and setting an annulus seal between the bore and the external seal surface of the casing hanger, wherein the annulus seal pushes downward on the release member, moving the ratchet ring to the engaged position, and for subsequently pulling the mandrel upward relative to the load ring to apply and maintain tension in the string of casing.

19. The apparatus according to claim 18, wherein:

the split of the load ring comprises opposing edges, each of the edges having a laterally extending recess; and the key has a pair of laterally extending lugs which engage the edges when the key is in the upper position and which enter the recesses when the key is in the lower position.

20. A method for running and supporting in tension a string of casing extending from a subsea wellhead assembly to a surface wellhead which has a bore with a load shoulder, comprising in combination:

mounting an annular casing hanger to the string of casing which has a disengaged position which allows downward movement of the string of casing relative to the casing hanger and an engaged position which allows upward movement of the string of casing relative to the casing hanger but prevents downward movement;

lowering the string of casing through the surface wellhead housing, landing the casing hanger on the load shoulder, then further lowering the string of casing to latch the string of casing to the subsea wellhead assembly while the casing hanger is in the disengaged position;

lowering and setting an annulus seal between the bore and an external seal surface of the casing hanger; and moving the casing hanger to the engaged position, then pulling the string of casing upward relative to the casing hanger to apply and maintain tension in the string of casing.

21. The method according to claim 20 wherein the step of lowering and setting the annulus seal causes the casing hanger to move to the engaged position.

* * * * *